US008525626B2

(12) United States Patent
Tait et al.

(10) Patent No.: US 8,525,626 B2
(45) Date of Patent: Sep. 3, 2013

(54) INTERLOCKING MAGNETIC COUPLING MEMBERS

(75) Inventors: Michael Tait, Lititz, PA (US); Adam Davis, Lancaster, PA (US); James Fairorth, Lancaster, PA (US)

(73) Assignee: Tait Towers Manufacturing LLC, Lititz, PA (US)

( * ) Notice: Subject to any disclaimer, the term of this patent is extended or adjusted under 35 U.S.C. 154(b) by 249 days.

(21) Appl. No.: 12/363,006

(22) Filed: Jan. 30, 2009

(65) Prior Publication Data

US 2009/0251250 A1 Oct. 8, 2009

Related U.S. Application Data

(60) Provisional application No. 61/042,007, filed on Apr. 3, 2008.

(51) Int. Cl.
*H01F 7/02* (2006.01)

(52) U.S. Cl.
USPC ..... 335/285; 335/306; 52/651.1; 52/DIG. 4

(58) Field of Classification Search
USPC ..... 335/285, 306; 52/651.1, DIG. 4
See application file for complete search history.

(56) References Cited

U.S. PATENT DOCUMENTS

| | | | | |
|---|---|---|---|---|
| 2,570,625 | A * | 10/1951 | Zimmerman et al. | 446/92 |
| 3,713,614 | A | 1/1973 | Taylor | |
| 4,238,905 | A * | 12/1980 | MacGraw, II | 446/92 |
| 4,422,137 | A | 12/1983 | Watts | |
| 4,917,778 | A * | 4/1990 | Takada et al. | 205/181 |
| 4,935,080 | A * | 6/1990 | Hassell et al. | 156/154 |
| 5,009,625 | A * | 4/1991 | Longuet-Higgins | 446/92 |
| 5,150,284 | A | 9/1992 | Dobert | |
| 5,472,163 | A | 12/1995 | Callas | |
| 5,664,298 | A * | 9/1997 | Nessar-Ivanovic | 24/303 |
| 5,895,018 | A | 4/1999 | Rielo | |
| 6,540,372 | B2 | 4/2003 | Joseph | |
| 7,275,294 | B1 | 10/2007 | Okuley | |
| 7,287,738 | B2 | 10/2007 | Pitlor | |
| 2005/0045784 | A1 | 3/2005 | Pitlor | |
| 2005/0102802 | A1 * | 5/2005 | Sitbon et al. | 24/303 |
| 2006/0077669 | A1 | 4/2006 | Thielemans et al. | |
| 2006/0278779 | A1 | 12/2006 | Killion | |
| 2007/0200038 | A1 | 8/2007 | Dautrey | |
| 2007/0216655 | A1 | 9/2007 | Chen et al. | |

FOREIGN PATENT DOCUMENTS

| | | |
|---|---|---|
| FR | 2801006 | 5/2001 |
| JP | 2001-231676 | 8/2001 |
| WO | 0054634 | 9/2000 |
| WO | WO 2007081830 A2 * | 7/2007 |

OTHER PUBLICATIONS

Wikipedia: Neodymium magnet (printed Jul. 30, 2011).*

* cited by examiner

*Primary Examiner* — Ramon Barrera
(74) *Attorney, Agent, or Firm* — McNees Wallace & Nurick LLC

(57) ABSTRACT

A magnetic coupling member, method, and system including a housing and a first arrangement of a plurality of magnets housed within the housing is disclosed. The first arrangement of magnets is selectively arranged and disposed to provide alignment and detachable engagement with a second arrangement of a plurality of magnets.

21 Claims, 13 Drawing Sheets

INTERLOCKING MAGNETIC COUPLING MEMBERS

CROSS REFERENCE TO RELATED PATENT APPLICATIONS

This application claims the benefit of U.S. Provisional Application No. 61/042,007, filed Apr. 3, 2008, which is hereby incorporated by reference in its entirety.

FIELD OF THE INVENTION

The present invention relates to magnetic couplings. More specifically, the present invention relates to interlocking magnetic couplings for use in conjunction with stages or platforms.

BACKGROUND OF THE INVENTION

In the performance industry, stages and platforms must be assembled and disassembled in relatively brief periods of time by relatively unskilled individuals. The assembly of these stages and platforms can require complex diagrams aiding the proper assembly of the stages and platforms, can require tools for locking the separate parts together, and can require several individuals working together. In other industries, other structures must be assembled and disassembled with similar needs.

The process of assembling and disassembling stages and platforms has required the use of tools and lightweight components. Known assembly processes suffer from the drawback that tools slow the assembly and/or disassembly process and require the assemblers to carry tools, which can be broken and/or misplaced.

Magnetic couplings are used in some industries for affixing devices to surfaces. Primarily, these devices rely solely upon the strength of the magnetic attraction to hold the devices in place. These systems suffer from the drawback that the magnet has weaker lateral attractive force permitting the magnet to be moved up or down on a metal surface thereby permitting relative movement between the surfaces. Although this adjustability may be helpful in some applications, this adjustability is not helpful when the magnets must be placed in a specific position with a specific orientation to provide support necessary for stages and platforms.

Therefore, there is an unmet need to provide an interchangeable mechanism with interchangeable parts, which can be assembled without the use of tools, and may be attracted together to a specific position with a specific orientation thereby providing support designed for use with stages and platforms.

SUMMARY OF THE INVENTION

This invention provides interlocking magnetic coupling members aiding for proper assembly of stages and platforms for interlocking separate parts together.

According to an embodiment, a magnetic coupling member includes a housing and a first arrangement of a plurality of magnets housed within the housing. In the embodiment, the first arrangement of magnets is selectively arranged and disposed to provide alignment and detachable engagement with a corresponding arrangement of a second arrangement of a plurality of magnets.

According to another embodiment, a method of assembling structures includes providing a magnetic coupling member, providing a corresponding structure having a second arrangement of magnets, and engaging the magnetic coupling member and the corresponding structure together. In the embodiment, the magnetic coupling member includes a first arrangement of magnets selectively arranged and disposed to provide alignment and detachable engagement with a corresponding arrangement of a second plurality of magnets.

According to another embodiment, an attachment system includes a first housing comprising a first arrangement of magnets and a second housing comprising a second arrangement, detachably engageable to the first housing. In the embodiment, the first housing is selectively arranged and disposed to provide alignment and detachable engagement with the second housing.

An advantage of the present invention includes manual connection/disconnection, including manipulation with a single hand.

Another advantage of the present invention includes providing an interchangeable mechanism with interchangeable parts.

Yet another advantage of the present invention includes permitting alignment and/or positioning in a specific position with a specific orientation.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to represent the same parts.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
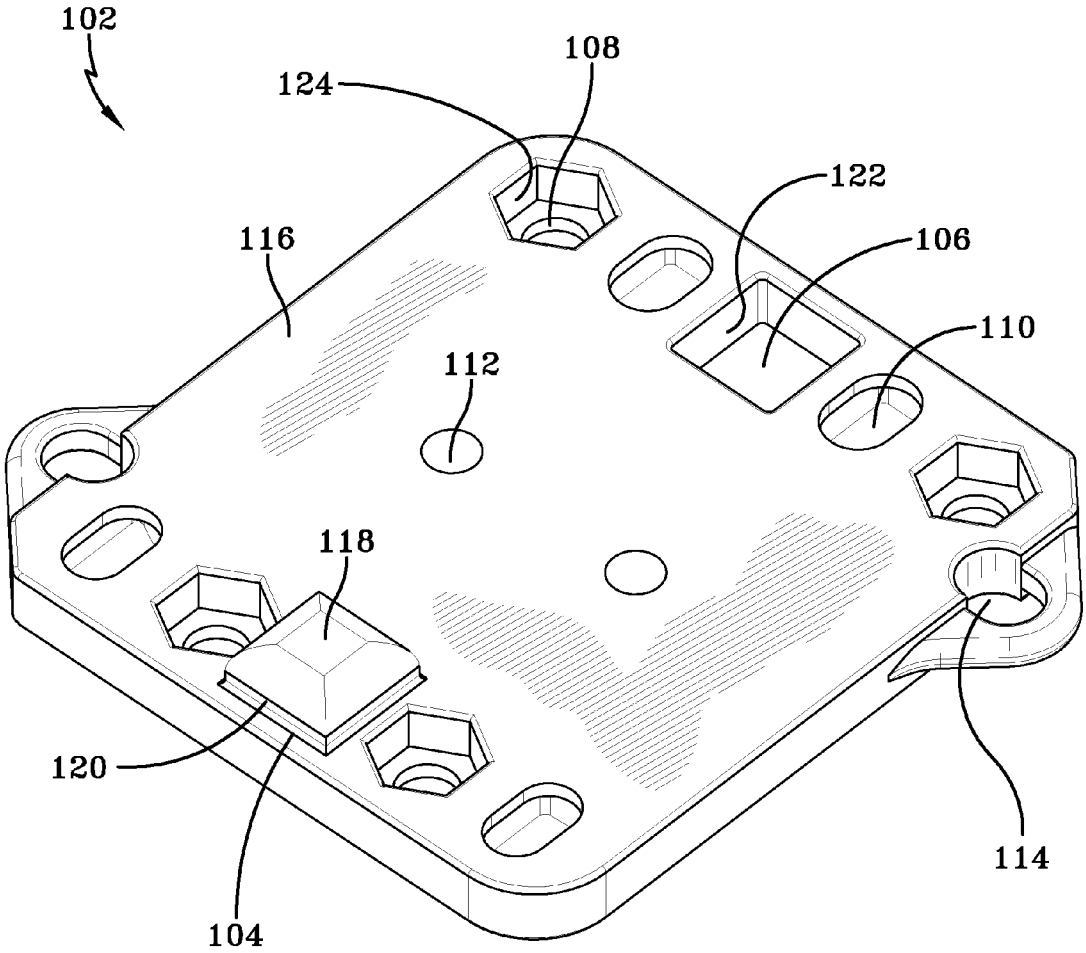
FIG. 1 illustrates a perspective view of an exemplary embodiment of the magnetic coupling member.

FIG. 1 illustrates a perspective view of an exemplary embodiment of a magnetic coupling member 102. In this embodiment, the magnetic coupling member 102 includes an interlocking feature 104, an interlocking receiving opening 106, a fastener opening 108, a fastener access opening 110, a through-opening 112, and a support opening 114. In this embodiment, the magnetic coupling member 102 may be machined, cast or otherwise formed of plastic or other non-magnetic material. In other embodiments, the magnetic coupling member 102 may be made of other materials that permit magnetic forces to magnetically attract and/or attach to other surfaces or structures.

The interlocking feature 104 is configured to be received by the interlocking receiving opening 106. While FIG. 1 shows a magnetic coupling member 102 having an interlocking feature 104, interlocking receiving opening 106, the magnetic coupling member 102 may include other configurations of interlocking features 104 and/or interlocking receiving openings 106 or may have no interlocking feature 104 or interlocking receiving opening 106. In the embodiment illustrated in FIG. 1, the interlocking feature 104 is a five-sided protrusion including a top-side 118 and four side walls 120 extending from a base 116 of the magnetic coupling member 102. The top-side 118 is of substantially planar geometry. The side walls 120 are of a sloped geometry. The interlocking receiving opening 106 is a recess or opening in the base 116 including four sides 122 with a sloping geometry configured to correspond with the geometry of the side walls 120 of the interlocking feature 104. The top-side 118 of the interlocking feature 104 is configured to be flush with the base 116 of a corresponding magnetic coupling member 102 when the interlocking feature 104 is inserted into a corresponding interlocking receiving opening 106. The side walls 120 are configured to abut the sides 122 of the corresponding interlocking receiving opening 106 when the interlocking feature 104 is inserted into the corresponding interlocking receiving opening 106. As illustrated in FIG. 1, the interlocking receiving opening 106 is configured to correspond to an interlocking feature 104 identical to the interlocking feature 104 depicted in FIG. 1. As depicted in FIG. 1, the magnetic coupling member 102 is configured to interlock or otherwise engage with substantially identical corresponding magnetic coupling member 102 or dissimilar magnetic coupling members 102 having corresponding interlocking features 104 and/or interlocking receiving openings 106. In other embodiments, the magnetic coupling members 102 may be configured to correspond with other panels or features that are not magnetic coupling members 102.

FIG. 1 further illustrates an embodiment of the magnetic coupling member 102 including a fastener opening 108 defined by hexagonal sides 124 and a stopping base 126. The fastener opening 108 is configured to permit a screw, nut, bolt, or other fastener to be inserted into the fastener opening 108. In the embodiment illustrated in FIG. 1, the hexagonal sides 124 may correspond with a hexagonal nut (or hex nut). As will be understood by those skilled in the art, other geometric configurations may be used for other fasteners. In the embodiment in FIG. 1, the hexagonal sides 124 are capable of preventing the hex nut from rotating after the hex nut has been fully inserted into the fastener opening 108. In FIG. 1, the stopping base 126 is a ring protruding from the hexagonal sides 124. The stopping base 126 is configured to provide a stopping means limiting how far fasteners may be positioned upon being inserted into the fastener opening 108. As will be understood by those skilled in the art, other geometric configurations may be used to correspond to other fasteners.

FIG. 1 further illustrates the fastener access opening 110 corresponding to the fastener opening 108 depicted in the embodiment in FIG. 1. In the embodiment illustrated in FIG. 1, the fastener access opening 110 is configured to permit fasteners to protrude beyond the base 116 of the magnetic coupling member 102 when the magnetic coupling member 102 is interlocked with a corresponding magnetic coupling member 102. This configuration permits the fastener to be longer thereby preventing unthreading of a screw used in conjunction with a nut as a fastener. In the embodiment illustrated in FIG. 1, the fastener access opening 110 is further configured to prevent the hex nut from going through the fastener access opening 110. This configuration may act as an additional alignment feature. In one embodiment, the screw portion engages one or more surfaces of the fastener access opening 110 providing additional stability. This additional stability may be provided by the screw protruding to a point that the magnetic coupling members 102 may only be detached by pulling them apart in a lateral position without any sort of angled force.

Also depicted in the embodiment illustrated by FIG. 1 is the through-opening 112 configured to permit a wire, rope, circular metal, or fastening means to be inserted through the through-opening 112. In the embodiment of FIG. 1, the through-opening 112 corresponds to a through-opening 112 in another identical magnetic coupling member 102. When the magnetic coupling members 102 are interlocked or otherwise engaged, the through-openings 112 may used for the purpose of further securing the magnetic coupling members 102 to each other by metal wires being pushed through the through-openings 112 and attached on each side of the through-opening 112.

The support opening 114 depicted in the embodiment illustrated in FIG. 1 is a semicircle extending from the base 116 of the magnetic coupling member 102 permitting supports or other external components or devices to be attached to the magnetic coupling member 102. In the embodiment illustrated in FIG. 1, the support opening 114 is defined by a semicircle comprised of the same material as the base 116. As will be understood by those skilled in the art, the support opening 114 geometry may be configured to correspond to specific features as needed and may be defined by loops, buttons, slits, slots, recesses, or other geometries corresponding to other features. In other embodiments, the fastener openings 108, the fastener access openings 110, the through-openings 112, and the support openings 114 are used for fastening, attaching, or securing the magnetic coupling to a corresponding magnetic coupling, a wall, a portable support, a floor, a ceiling, a wire, a cable, a tarp, a covering, a stage, a platform, an architectural structure, a pole, a vehicle, light, a fixture, a door, and/or any other structure.

Figure 2:
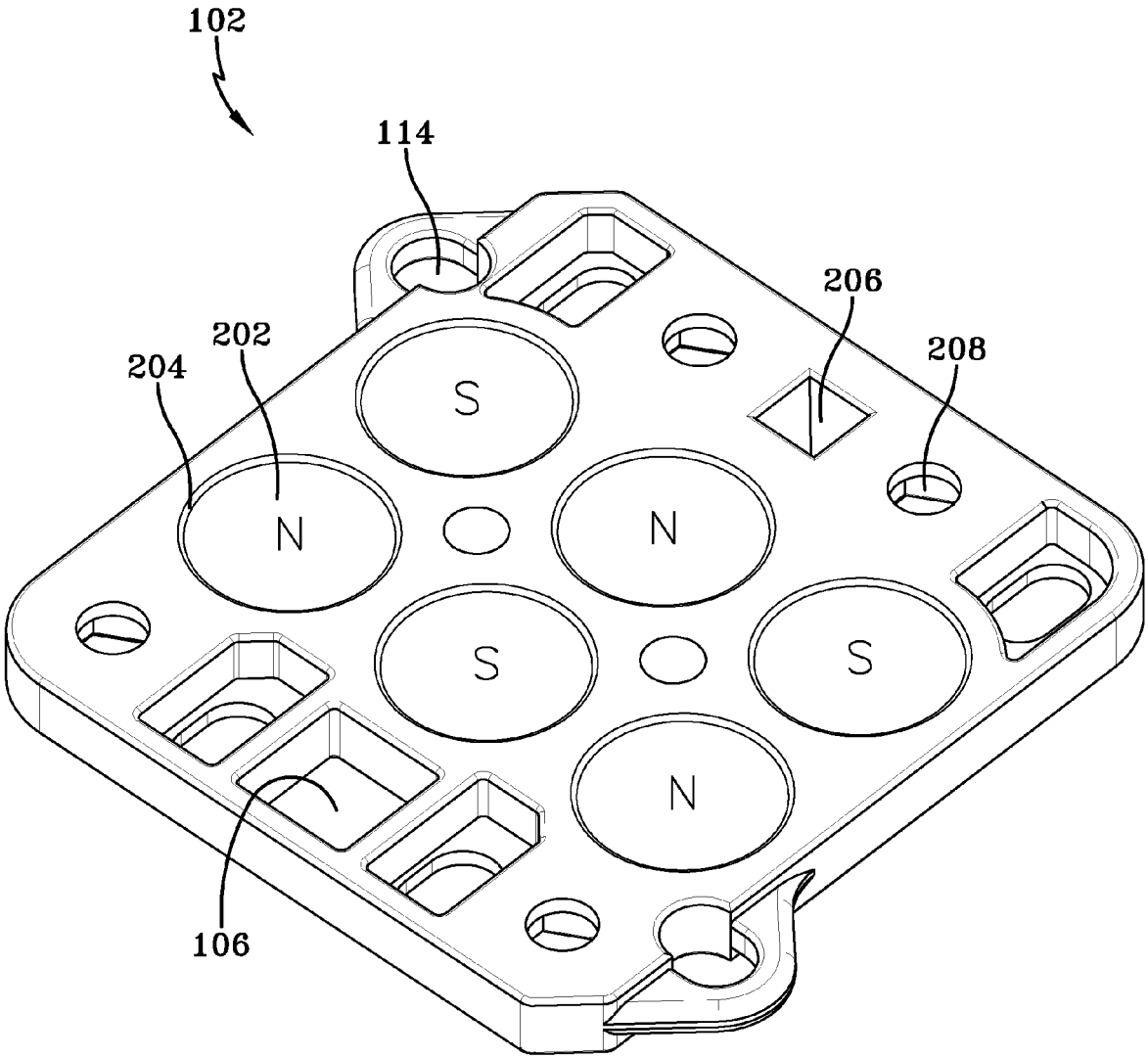
FIG. 2 illustrates a reverse perspective view of an exemplary embodiment of a magnetic coupling member.

FIG. 2 illustrates a reverse perspective view of an exemplary embodiment of the magnetic coupling member 102. The reverse perspective view is the opposite side of the magnetic coupling member 102 as the perspective view depicted in the embodiment illustrated in FIG. 1. The magnetic coupling member 102 is magnetically attractive by inclusion of a plurality of magnets 202. As illustrated in the embodiment depicted by FIG. 2, the magnets 202 are arranged with two parallel sets of magnets 202, one set arranged in north-south-north orientation and the other set arranged in south-north-south orientation. As utilized hereinafter, "north" and "south" are defined as opposed magnetic poles. However, any arrangements of poles having alternatively attractive or repulsive poles may be used. In other embodiments, the magnets 202 may be arranged in other configurations. The arrangement of the magnets 202 allows for simple and consistent positioning and/or alignment of a structure 302 (shown in FIG. 3) corresponding to the magnetic coupling member 102 by limiting the orientation of the magnetic coupling member 102 to a specific orientation. The alignment and positioning of the magnetic coupling member 102 is substantially independent of the interlocking feature 104 and the interlocking receiving opening 106, wherein the interlocking feature 104 and the interlocking receiving opening 106 may be omitted. This arrangement of magnets 202 permits an individual to place the corresponding magnetic coupling member 102 on the other magnetic coupling member 102 by simply bringing the corresponding magnetic coupling member 102 in sufficiently close proximity to the other magnetic coupling member 102 to permit magnetic attraction to interlock or otherwise engage the magnetic coupling members 102. It is not necessary to preliminarily align the magnetic coupling members 102 as the attractive and repulsive forces of the selectively positioned magnets 202 permit consistent interlocking of the magnetic coupling members 102 in the desired orientation.

The embodiment of the magnetic coupling member 102 illustrated in FIG. 2, depicts recesses 204 configured to house the magnets 202. In this embodiment, the recesses 204 cylindrically correspond to the cylindrical geometry of the magnets 202. In other embodiments, the recesses may be of a different geometry corresponding to geometry of the magnets 202. In the embodiment illustrated by FIG. 15, the magnetic coupling member 102 does not include an interlocking feature 104. In this embodiment, the alignment and/or engagement of a corresponding magnetic coupling member 102 is achieved by magnets.

Also illustrated in FIG. 2 are the interlocking feature 104, the interlocking receiving opening 106, the fastener openings 108, the fastener access openings 110, the through-openings 112, and the support openings 114. The reverse view of the interlocking feature 104 is depicted as a cavity 206 defining the interior of the interlocking feature 104. Other embodiments do not include the cavity 206. In the embodiment illustrated in FIG. 2, the interlocking receiving opening 106 is depicted as substantially the same in the reverse view as the view in FIG. 1. In other embodiments, the interlocking receiving opening 106 may not be visible in reverse view because, in those embodiments, the interlocking receiving opening 106 includes a surface defining a bottom of the interlocking receiving opening 106 configured to stop the interlocking feature 104. In the embodiment illustrated in FIG. 2, the fastener openings 108 are depicted as circular openings 208 configured to permit the screw or shaft portion of a fastener to fit though the circular openings 208. In the embodiment illustrated in FIG. 2, the fastener access openings 110 are depicted as including a fastener access opening recess 210. The fastener access opening recess 210 prevents a nut, bolt, or other fastener from traveling through the fastener access opening 110. The fastener access openings 110 permit access to the fastener for a corresponding magnetic coupling member 102 or the magnetic coupling member 102 when the magnetic coupling members 102 are interlocked or otherwise engaged. In the embodiment of FIG. 2, the reverse view of the through-openings 112 and the support openings 114 depicts the through-openings 112 and the support openings 114 as substantially the same as in the view of the embodiment illustrated in FIG. 1. Those skilled in the art will understand that the arrangement and configurations of all of the openings can be modified to meet specific needs for specific applications.

Figure 3:
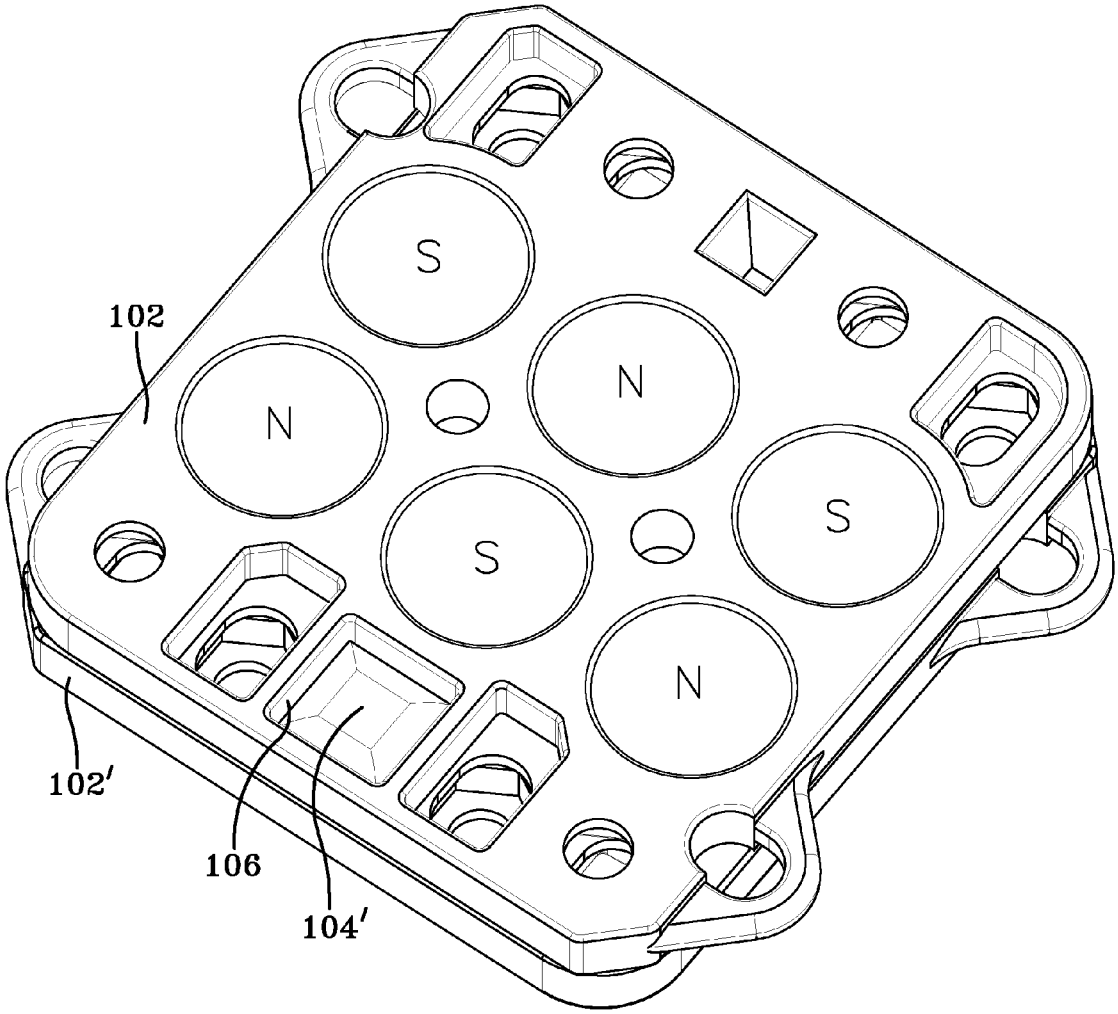
FIG. 3 illustrates an exemplary embodiment of the magnetic coupling member interlocked with a corresponding magnetic coupling member.

FIG. 3 illustrates an exemplary embodiment of the magnetic coupling member 102 interlocked with a corresponding magnetic coupling member 102'. As depicted in the illustration of the embodiment in FIG. 3, the interlocking feature 104' of the corresponding magnetic coupling member 102' is interlocked with the interlocking receiving opening 106 thereby permitting the interlocking feature 104' to be visible through the interlocking receiving opening 106.

Figure 4:
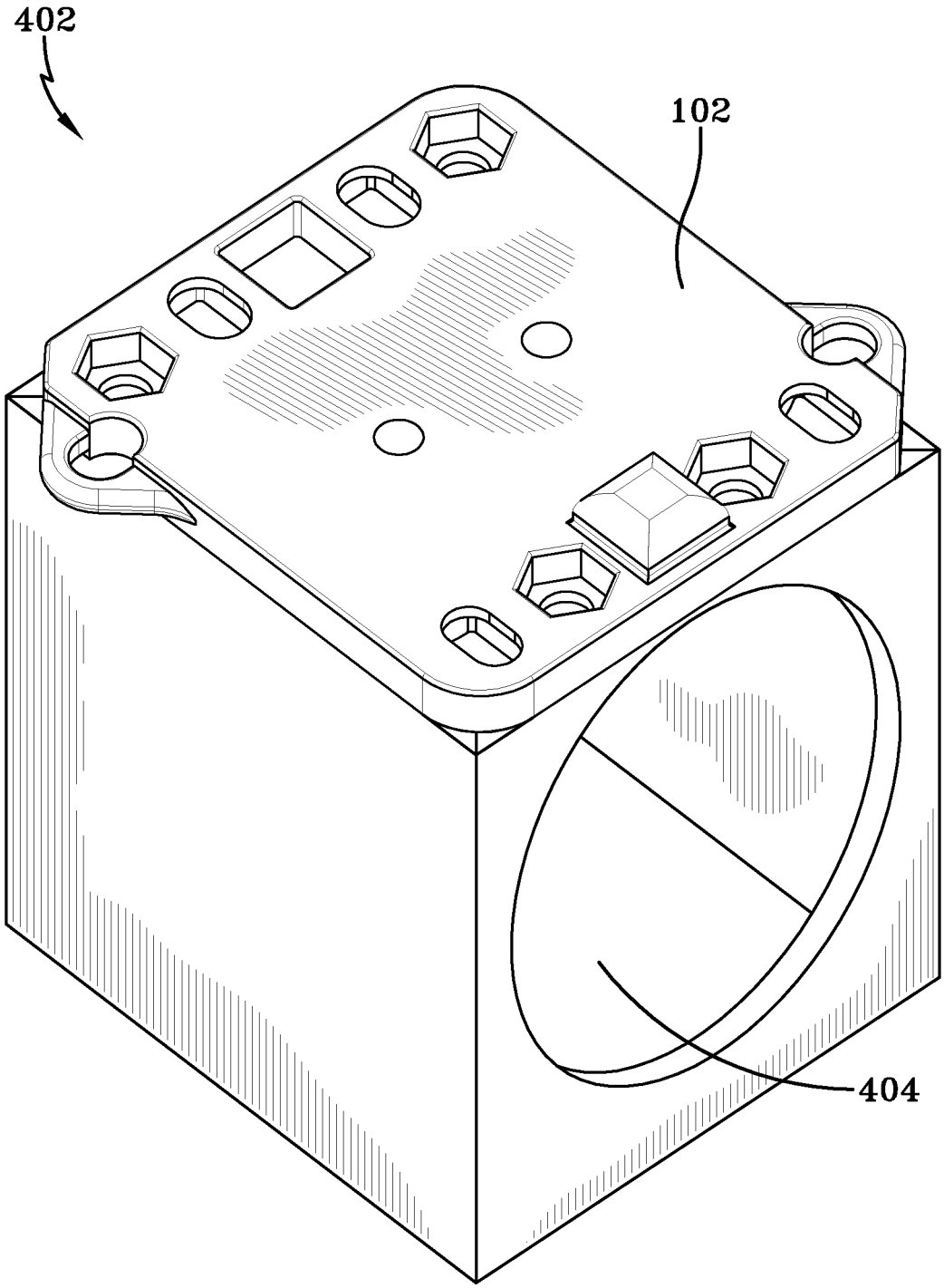
FIG. 4 illustrates an exemplary embodiment of the magnetic coupling member affixed to a cuboid structure.

FIG. 4 illustrates an exemplary embodiment of the magnetic coupling member 102 affixed to a cuboid structure 402. In this embodiment, the magnetic coupling member 102 defines a side of the cuboid structure 402. The cuboid structure 402 generally has four sides and an open top 404 and open bottom (not shown) permitting corresponding couplings to fit into the open top 404 of the cuboid structure 402. The open top 404 is configured to permit a corresponding coupling or other insert to be inserted into the cuboid structure 402 while permitting the cuboid structure 402 to attach to other structures. In one embodiment, a support member is inserted into the open top 404, where the support member (not shown) attaches to the cuboid structure 402. In the embodiment illustrated in FIG. 4, the magnetic coupling member 102 can interlock with a corresponding magnetic coupling member 102 thereby permitting any structure attached to the corresponding magnetic coupling member 102 to be affixed by means of the interlocked magnetic coupling members 102 to the cuboid structure 402.

Figure 11:
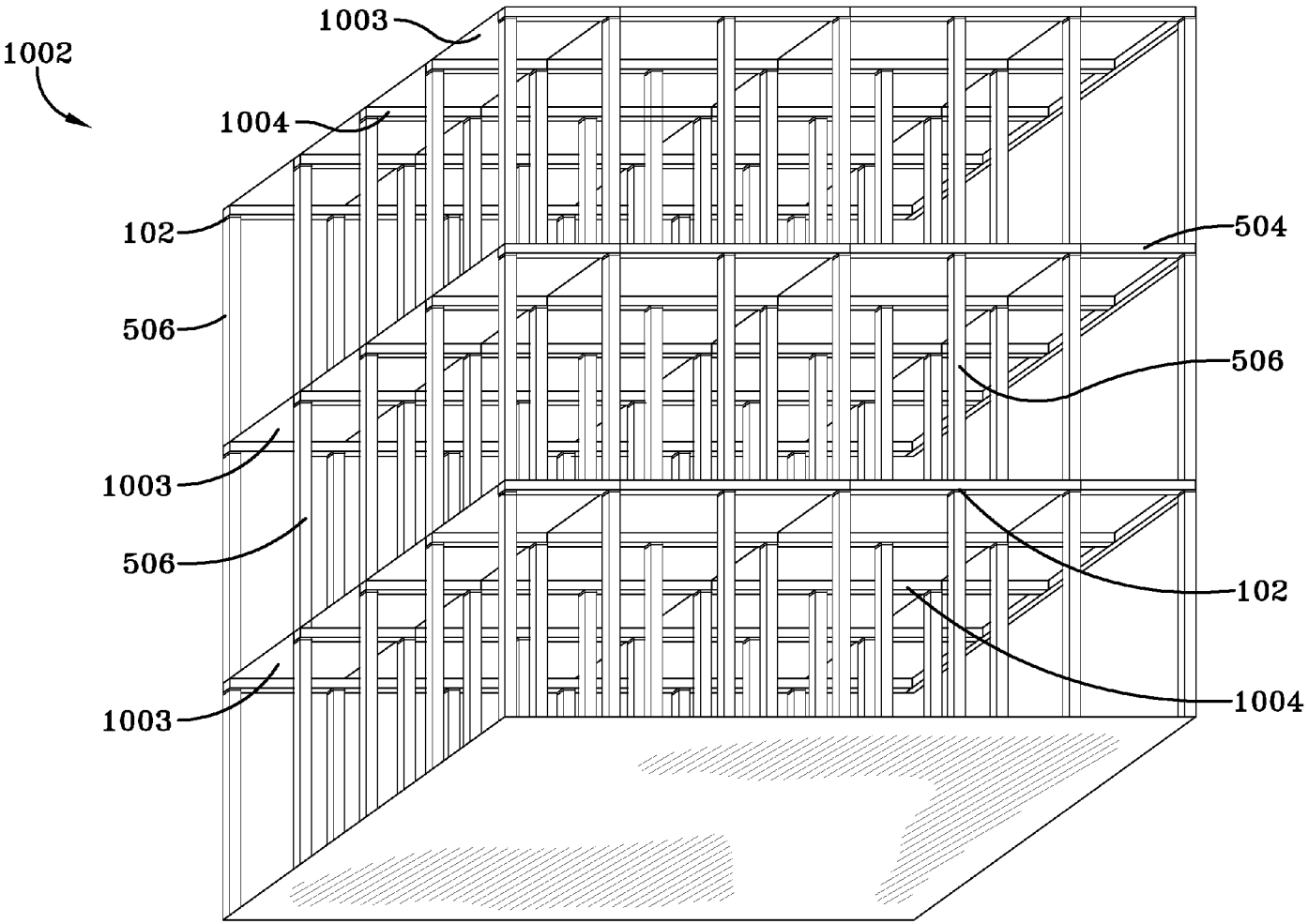
FIG. 11 illustrates an exemplary embodiment of the magnetic coupling member applied to the scaffolding.
Figure 12:
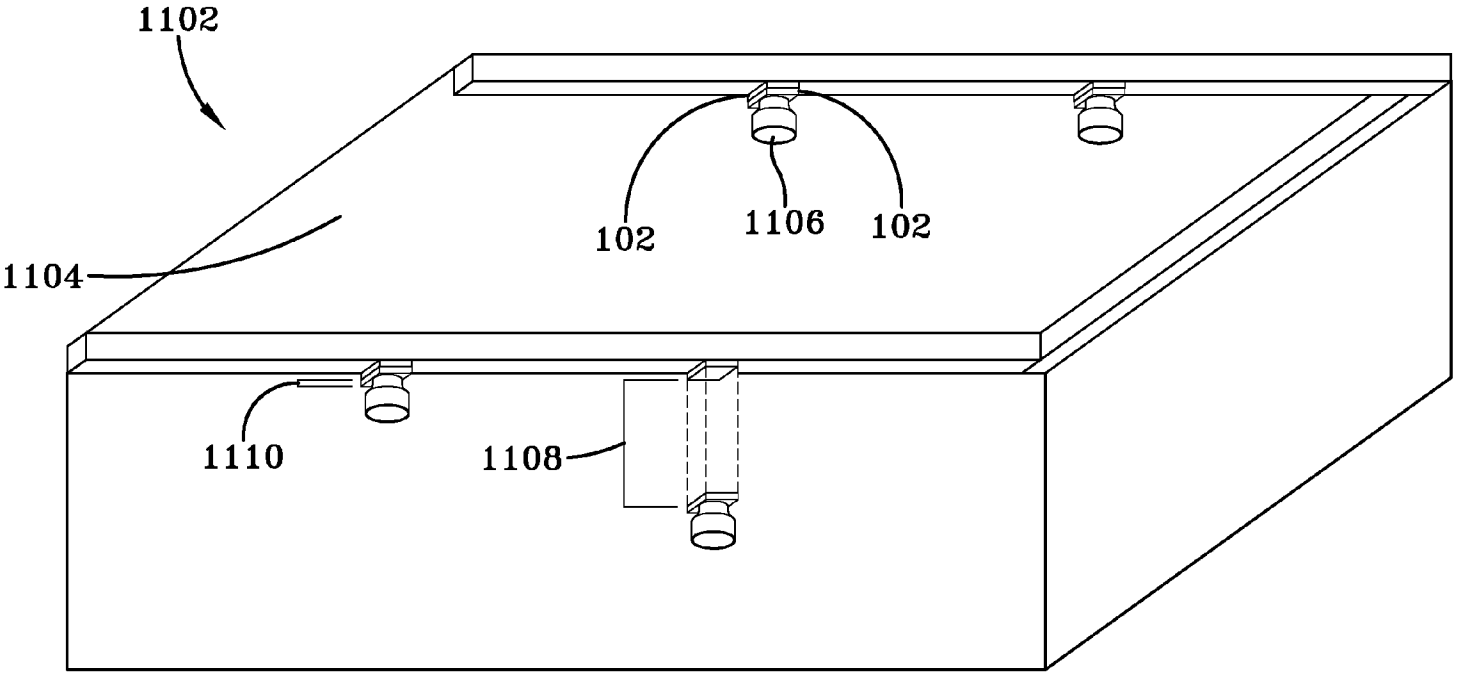
FIG. 12 illustrates an exemplary embodiment of the magnetic coupling member applied to the theatrical set.
Figure 13:
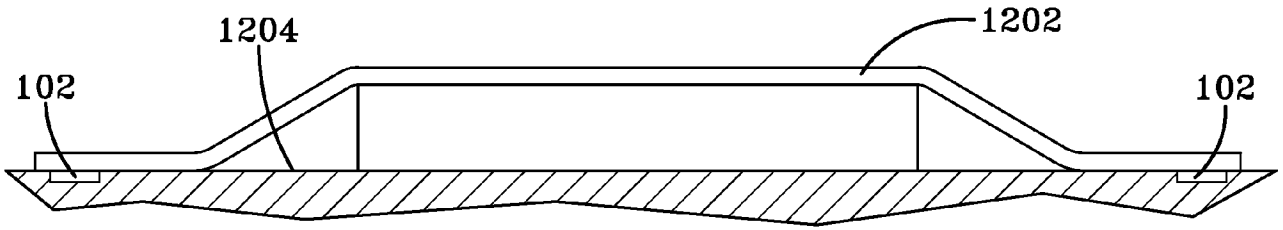
FIG. 13 illustrates an exemplary embodiment of the magnetic coupling member being applied to a covering.

In other embodiments, the corresponding magnetic coupling member 102 may be attached to a stage or platform system 502 (see FIGS. 5 and 6), soft goods 702 (see FIG. 7), an architectural structure 802 (see FIG. 8), a ceiling 902 (see FIGS. 9 and 14), a scaffolding 1002 (see FIG. 11), a theatrical set 1102 (see FIG. 12), or other structures (see FIGS. 12 and 13). In some embodiments, the cuboid structure 402 includes or is attracted to a plurality of magnetic coupling members 102. The corresponding magnetic coupling members 102 may be attached directly to the other structure or as part of a structure.

Figure 5:
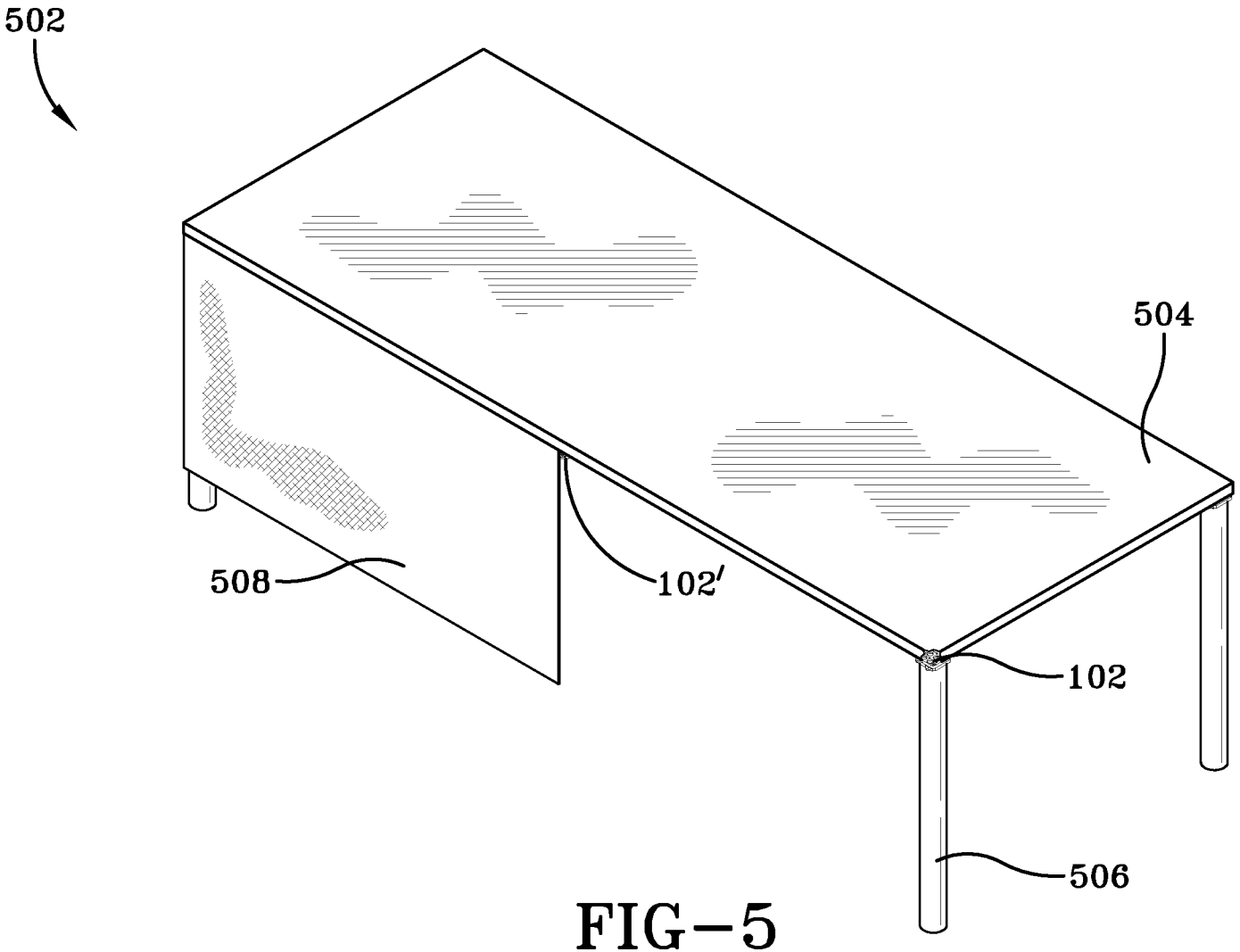
FIG. 5 illustrates an exemplary embodiment of the magnetic coupling member applied to a stage or platform system.

FIG. 5 illustrates an exemplary embodiment of the magnetic coupling member 102 applied to a stage or platform system 502. In the embodiment illustrated by FIG. 5, the magnetic coupling members 102 are disposed below a stage surface 504. FIG. 5 illustrates an embodiment of the magnetic coupling member 102 configured to permit a vertical support 506 to attach to the magnetic coupling member 102. FIG. 5 further illustrates an embodiment of the magnetic coupling member 102' configured to suspend from the stage surface 504 without being supported by the vertical support 506. FIG. 5 further illustrates a covering device 508 attached to the front of the stage or platform system 502. The covering device 508 may be attached by magnetic couplings 102, which are covered by the covering device 508. In one embodiment, the covering device 508 is of a material magnetically attracted to the magnetic coupling members 102. This material includes, but is not limited to, magnetically attractable metal, such as iron or iron alloys, sheet metal, metallic drapes, metallic fabric, and magnetic polymers. In another embodiment, the covering device 508 includes corresponding magnetic coupling members 102 that permit the covering device 508 to be positioned and oriented by interlocking with the magnetic coupling members 102 disposed below the stage surface 504. In this embodiment, the covering device 508 may be any material that is attractable to magnetic coupling members 102. In yet another embodiment, the covering device 508 includes corresponding structures configured to interlock with the magnetic coupling members 102. The corresponding structures include, but are not limited to, magnetically attractable metallic structures affixed to the covering surface, such as iron or iron alloys, any other substance subject to magnetic attraction, structures allowing for the attachment of magnetically attractable metal facades, bars, planks, panels, or other structures including a portion that will magnetically attach or engage to the magnetic coupling members 102. In addition, multiple magnetic coupling members 102 may be present. The plurality of magnetic coupling members 102 may be oriented in other directions based upon the needs of the specific structure.

Figure 6:
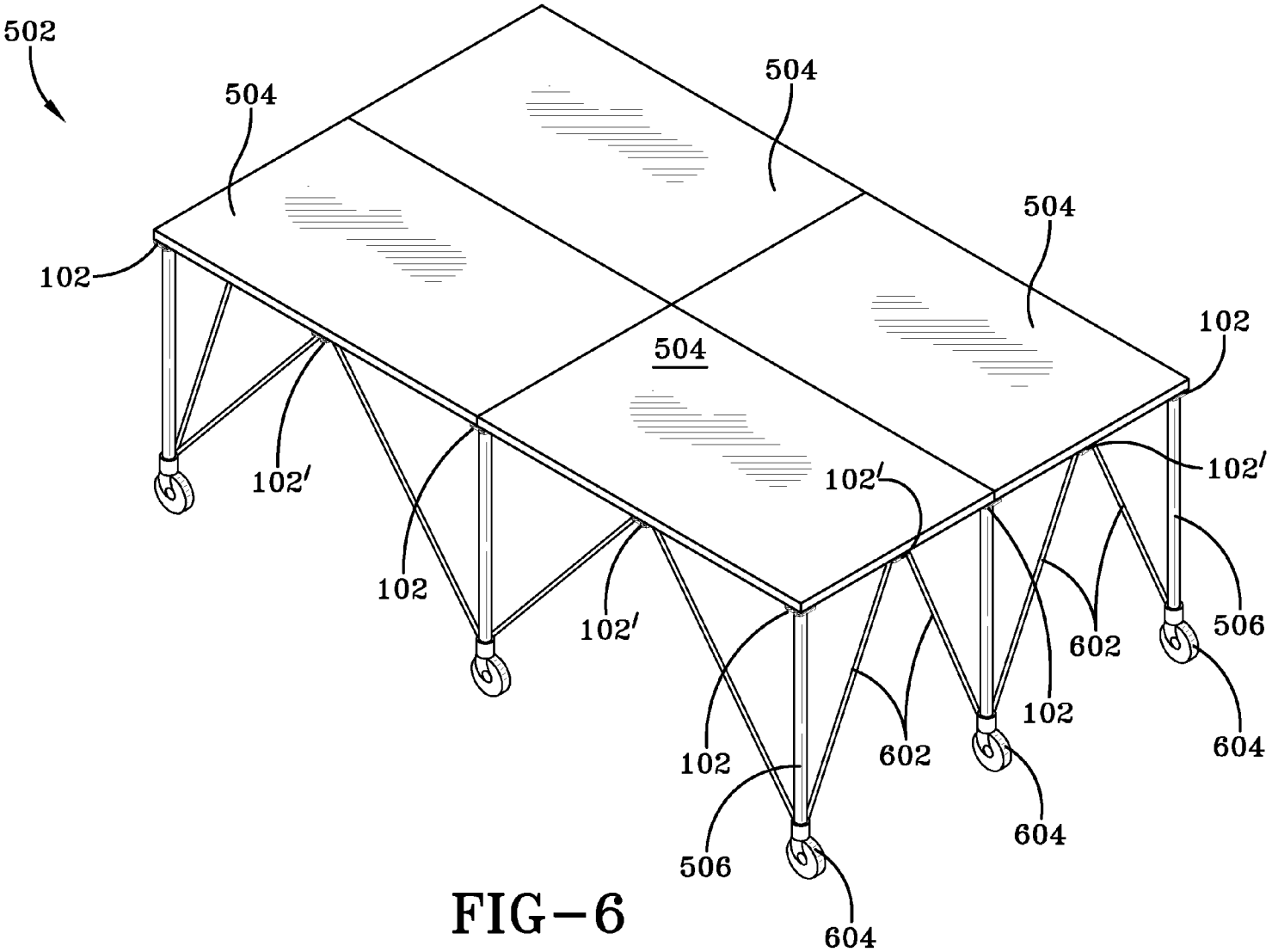
FIG. 6 illustrates an exemplary embodiment of the magnetic coupling member applied to a stage or platform system.

FIG. 6 illustrates an exemplary embodiment of the magnetic coupling member 102 applied to a stage or platform system 502. In this embodiment, the magnetic coupling members 102 are disposed below the stage surface 504. FIG. 6 illustrates an embodiment of the magnetic coupling members 102 configured to permit a vertical support 506 to attach to the magnetic coupling member 102. FIG. 6 also illustrates an embodiment of the magnetic coupling members 102' configured to permit a diagonal support 602 to attach to the magnetic coupling members 102' by latching onto the support opening 114 on the magnetic coupling member 102'. FIG. 6 further illustrates that the stage or platform system 502 may include wheels 604. As will be understood by those skilled in the art, the stage or platform system 502 may include any features necessary to meet specific needs.

Figure 7:
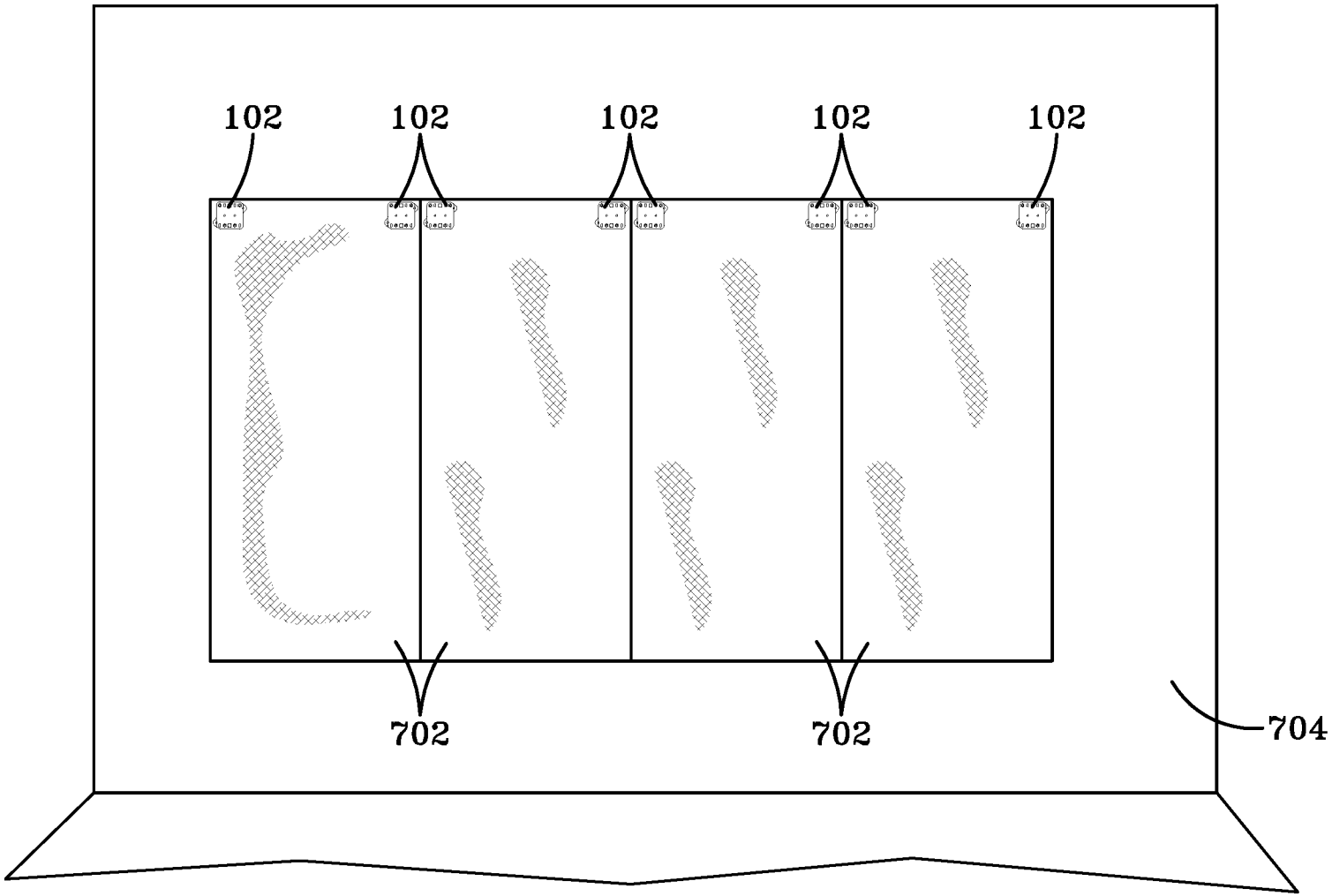
FIG. 7 illustrates an exemplary embodiment of the magnetic coupling member applied to soft goods.

FIG. 7 illustrates an exemplary embodiment of the magnetic coupling member 102 applied to soft goods 702. In the embodiment of the magnetic coupling member 102 illustrated in FIG. 7, the magnetic coupling member 102 is attached to the soft goods 702. Although not visible in FIG. 7, a corresponding magnetic coupling member 102 is attached to a wall 704 or other supporting structure thereby permitting the magnetic coupling members 102 to interlock and support the soft goods 702. In another embodiment, the soft goods 702 may be constructed of a magnetic material. In this embodiment, the magnetic coupling may be attached to the wall 704 and the soft goods 702 is supported by the magnetic coupling member 102. In yet another embodiment, a metallic panel corresponding with the magnetic coupling member 102 may be attached to the soft goods 702 thereby permitting the magnetic coupling member 102 to interlock with the metallic panel and support the soft goods 702.

Figure 8:
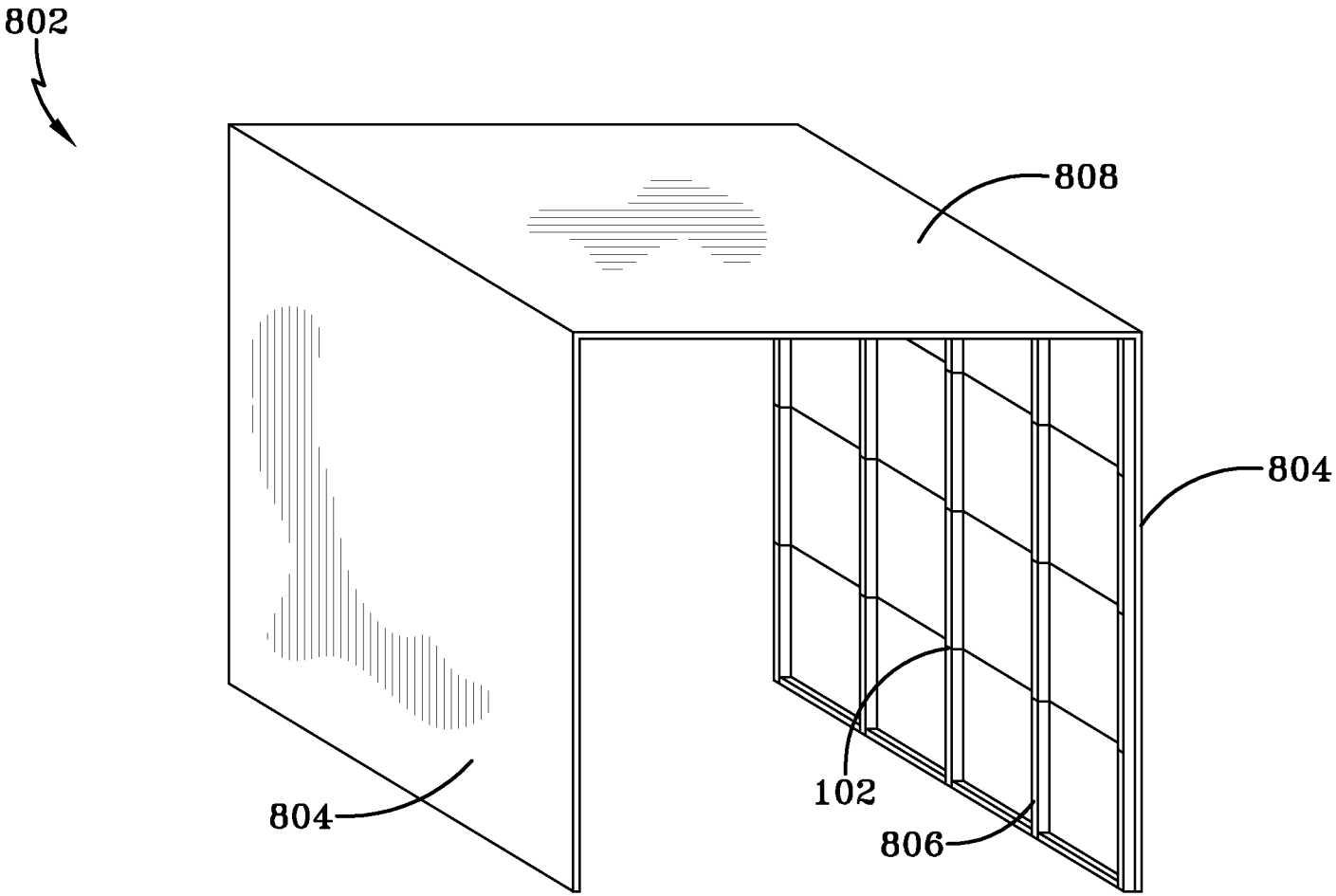
FIG. 8 illustrates an exemplary embodiment of the magnetic coupling member applied to an architectural structure.

FIG. 8 illustrates an exemplary embodiment of the magnetic coupling member 102 applied to an architectural structure 802. The architectural structure 802 depicted in FIG. 8 is a tunnel. In other embodiments, the magnetic coupling member 102 may be applied to bridges, buildings, trusses and other architectural structures. As depicted in the embodiment of the magnetic coupling member 102 illustrated in FIG. 8, the magnetic coupling members 102 align the interior of the side walls 804. In this embodiment, the magnetic coupling members 102 are located on architectural supports 806 to permit added strength for features attached to the architectural structure 802 by means of the magnetic coupling members 102. In another embodiment, the magnetic coupling members 102 may be located on the exterior of the side walls 804. In yet another embodiment, the magnetic coupling members 102 may be located on the exterior of the top wall 808. In yet another embodiment, similar to the embodiment illustrated in FIG. 9, the magnetic coupling members 102 may be located on the interior of the top wall 808.

Figure 9:
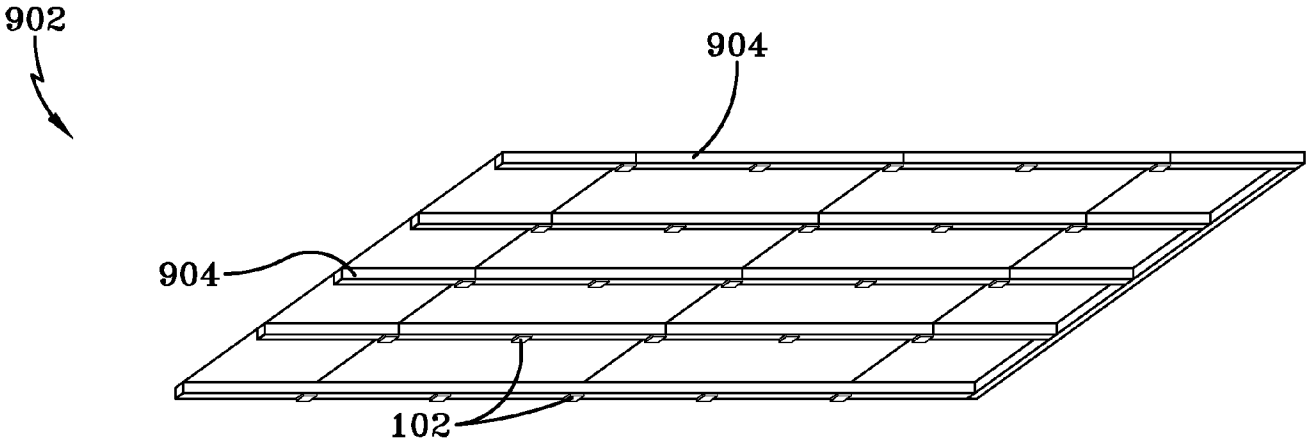
FIG. 9 illustrates an exemplary embodiment of the magnetic coupling member applied to the ceiling.
Figure 10:
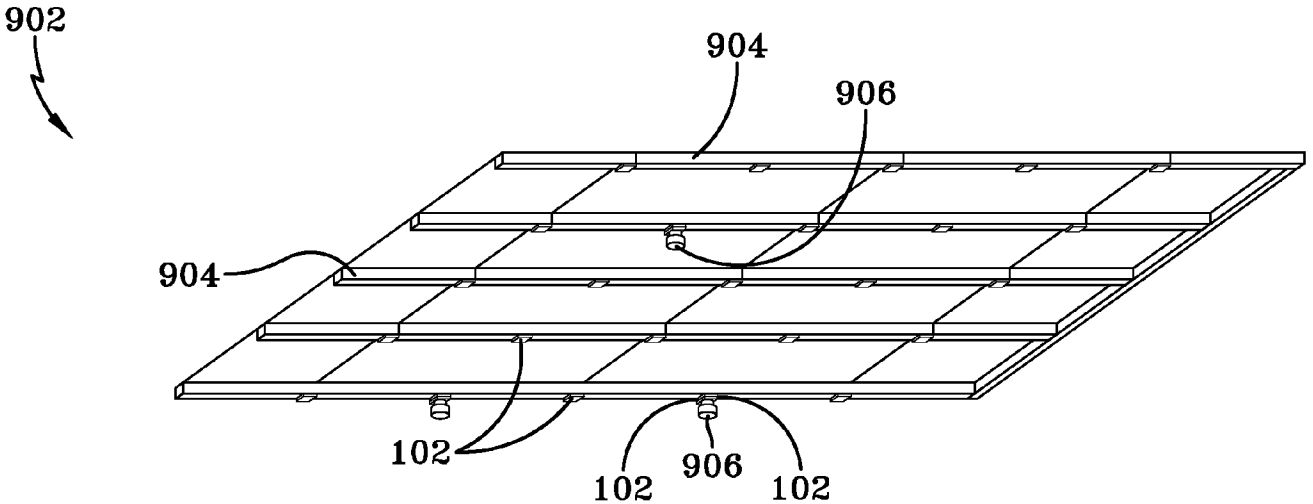
FIG. 10 illustrates an exemplary embodiment of the magnetic coupling member applied to the ceiling with light fixtures.

FIG. 9 illustrates an exemplary embodiment of the magnetic coupling member 102 applied to the ceiling 902. In this embodiment, the magnetic coupling members 102 are affixed to ceiling supports 904. Ceiling supports 904 may include beams, trusses, or other structures utilized to support components. The magnetic coupling members 102 are used for attaching and suspending any sort of feature to the ceiling 902 by means of the magnetic coupling member 102. The ceiling 902 may be for use in a building, bridge, pavilion, theatre, boat, garden, patio, recreational vehicle, or any other area defined by a top surface. In one embodiment, illustrated in FIG. 10, a light fixture 906 may be attached to the magnetic coupling member 102, which is attached to the ceiling 902.

FIG. 11 illustrates an exemplary embodiment of the magnetic coupling member 102 applied to the scaffolding 1002 or other multiple level structure. In FIG. 11, the magnetic coupling members 102 are disposed below a substantially planar surface 1003 and attached to lateral supports 1004. In this embodiment, the magnetic coupling members 102 are configured to permit the vertical supports 506 to releasably attach and/or mate and/or engage with the magnetic coupling members 102 at or near the lateral supports 1004. The substantially planar surface depicted in this embodiment is substantially identical to the stage surface 504 in FIGS. 5 and 6. However, in other embodiments, the scaffolding 1002 may be erected without the substantially planar surface. In other embodiments, similar multi-level structures may be used. In addition, secondary supports may be utilized to further support the substantially planar surfaces. These multi-level structures are applicable to the embodiments illustrated by FIGS. 5, 6, and 8.

FIG. 12 illustrates an exemplary embodiment of the magnetic coupling member 102 applied to a lighting assembly 1102 for a theatrical set or other environment requiring light. In the embodiment of the magnetic coupling members 102 depicted in FIG. 12, the magnetic coupling members 102 are disposed below a lighting assembly 1102. In this embodiment, the magnetic coupling members 102 are directly connected to the lighting assembly 1102. In other embodiments, the magnetic coupling members 102 are connected to supports or cables that are connected to the lighting assembly 1102. In one embodiment, the lighting assembly 1102 includes one or more trusses for attachment of light fixtures 906. FIG. 12 further illustrates the magnetic coupling members 102 connected with corresponding magnetic coupling members 102. The corresponding magnetic coupling members 102 are attached to light fixtures 906. This configuration permits the lighting fixtures to be removed 1108 and attached 1110 in various arrangements. In other embodiments, the magnetic coupling members 102 may be attached to posts, I-beams, cables, or other structures. In these other embodiments, the magnetic coupling members 102 similarly permit lighting fixtures to be removed, reconfigured, and attached in various arrangements. To permit flexibility in the positioning of the light fixtures 906, in one embodiment, the light fixtures 906 may be battery powered or powered by a portable power source. In other embodiments, the light fixtures 906 are plugged in at or near the magnetic coupling member 102. For example, in order to hide wires providing power and/or signals to lighting fixtures, in one embodiment, the wire may be fed through the through-opening 112 of both the magnetic coupling member 102 and the corresponding magnetic coupling member 102. In this embodiment, wires may be plugged in after being pulled through an opening in the lighting surface 1102. Although the above has been described with respect to light fixtures 906, other lighting components, such as a light emitting diode (LED) assembly, video screens, or other visual or theatrical components may be attached in the same manner.

FIGS. 12 and 13 illustrate an embodiment of the magnetic coupling members 102 applied to other structures. As illustrated by these figures, the magnetic coupling members 102 can be applied to a variety of other structures. For example, FIG. 13 illustrates the magnetic coupling members 102 being applied to a covering 1202. In this embodiment, the covering 1202 may be a tarp, a pool cover, a car cover, an awning, or any other flexible substance. In the embodiment illustrated in FIG. 13, the magnetic coupling member 102 is attached to a surface 1204, such as the ground, and a magnetic portion of the covering 1202 is magnetically attached to the magnetic coupling member 102. The magnetic portion can be any magnetically attracted material including, but not limited to, a magnetically attractable plate, a fabric, a coating, a polymer, and/or a corresponding magnetic coupling member 102.

Figure 14:
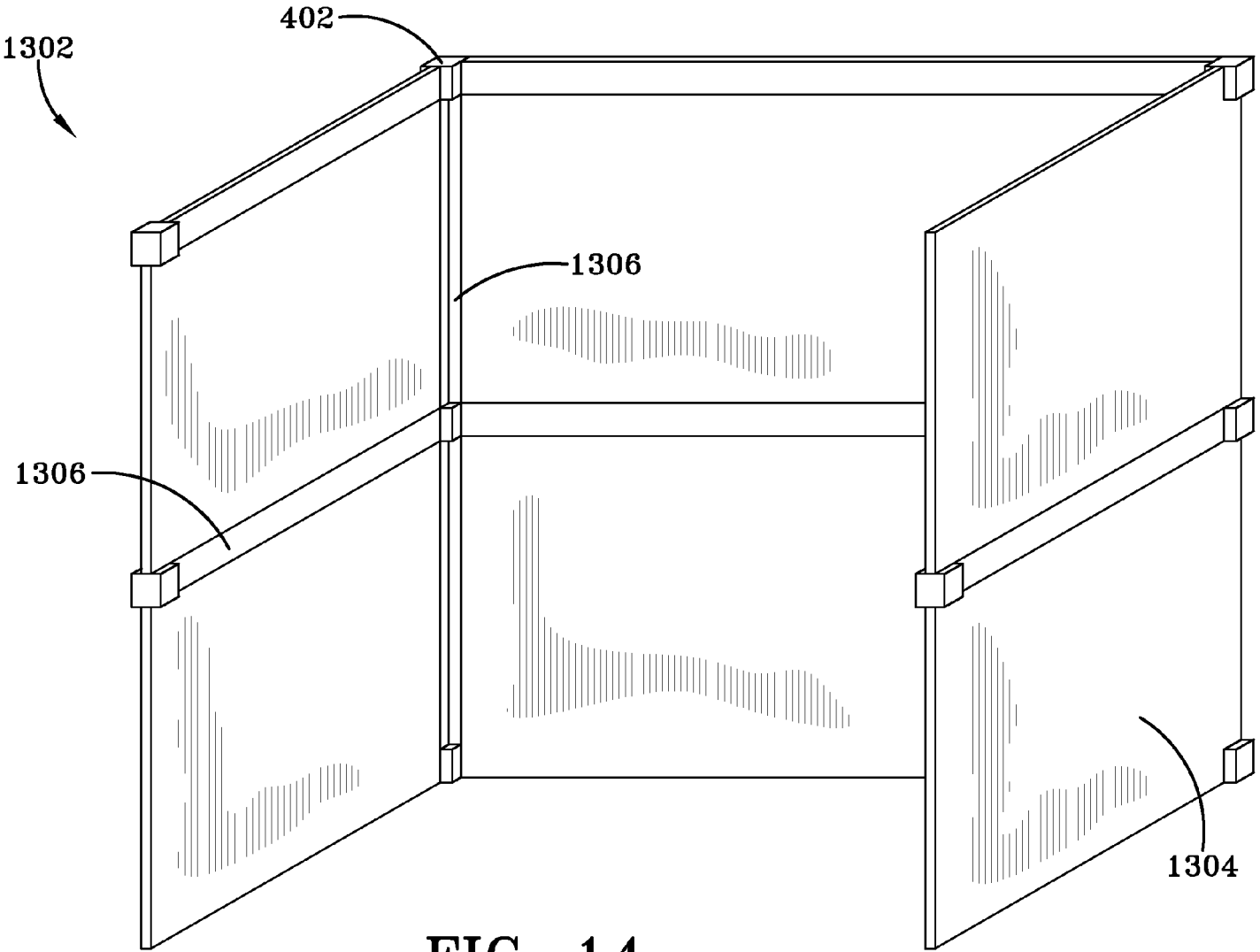
FIG. 14 illustrates an exemplary embodiment of the magnetic coupling members applied to modular office furniture.

FIG. 14 illustrates the magnetic coupling members 102 applied to modular office furniture 1302 as is frequently erected and assembled in office environments. In the embodiment of the magnetic coupling members 102 illustrated by FIG. 14, the magnetic coupling members 102 comprise multiple sides of a cuboid structure 402 (as illustrated in FIG. 4). In the embodiment illustrated by FIG. 14, the modular office furniture 1302 includes modular office furniture panels 1304 and modular office furniture supports 1306. The modular office furniture panels 1304 are held in place by the modular office furniture supports 1306. The modular office furniture supports 1306 are held in place by magnetic coupling members 102 affixed to the end of the modular office furniture supports 1306 or other magnetically attracted portions configured to mate with the magnetic coupling members 102. As with all of the other embodiments disclosed herein that include the selectively positioned magnets 202, in this embodiment, the selectively positioned magnets 202 within magnetic coupling member 102 permit the simultaneous alignment and attachment and/or engagement of the separate components.

Figure 15:
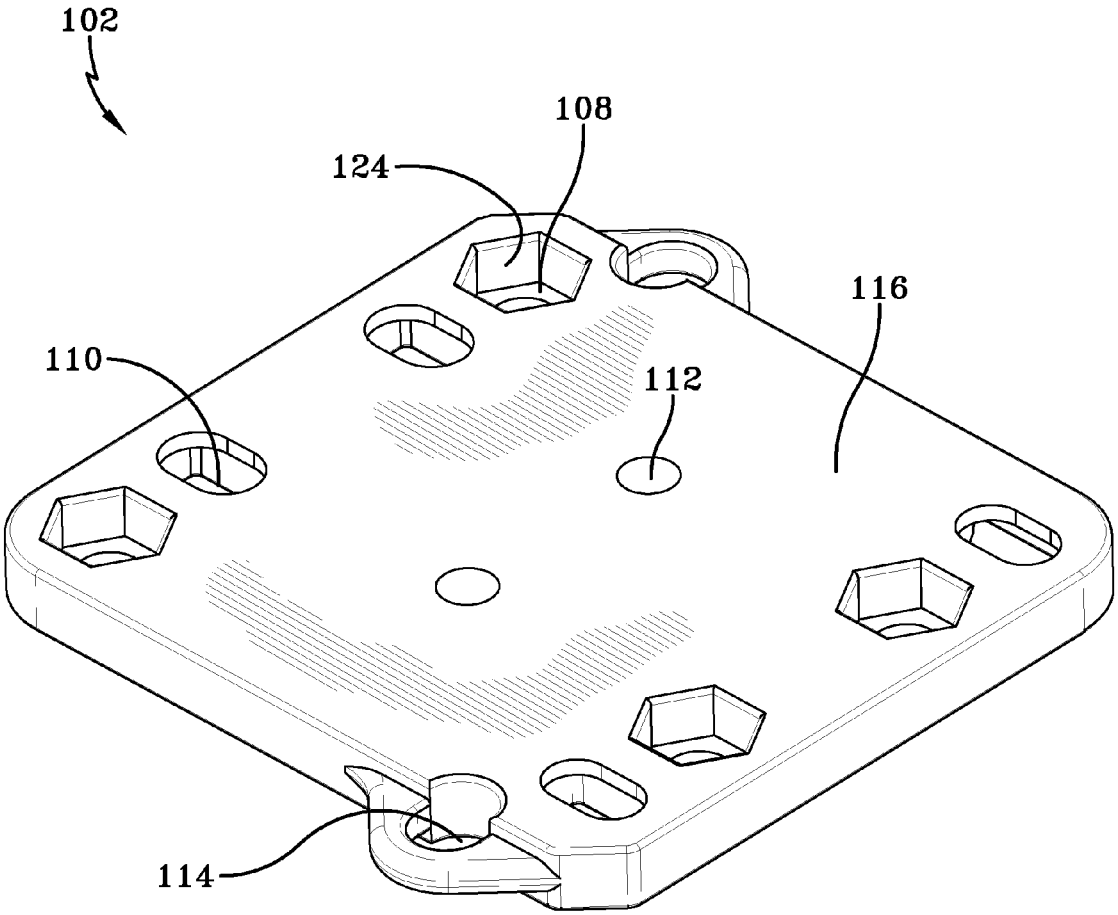
FIG. 15 illustrates a perspective view of an alternate exemplary embodiment of the magnetic coupling member.

FIG. 15 shows an alternate embodiment of magnetic coupling members 102 of the present disclosure that includes an arrangement substantially identical to the arrangement shown and described in FIGS. 1 and 2. However, the embodiment of FIG. 15 does not include an interlocking feature 104 or an interlocking receiving opening 106. The arrangement of magnets 202 provide both attractive force and alignment of the individual magnetic coupling members 102. As corresponding magnetic coupling members 102 (i.e. coupling members 102 having corresponding arrangements of magnets 202) are directed toward each other, the repulsive forces of like poles of the magnets 202 repel each other, while, simultaneously the opposite poles of the magnets 202 attract each other, permitting simultaneous attraction and alignment.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A magnetic coupling member comprising:

a housing; and a first arrangement of a plurality of magnets housed within the housing; and wherein the first arrangement magnets are selectively arranged and disposed to provide alignment and detachable engagement with a corresponding arrangement of a second plurality of magnets;

wherein at least two of the first plurality of magnets are arranged in a position to receive repulsive forces from at most three of the corresponding arrangement of the second plurality of magnets and to receive attractive forces from at most one of the corresponding arrangement of the second plurality of magnets during engagement; wherein the arrangement of the magnets permits the magnetic coupling member to attach to a corresponding structure in one specific position;

wherein the first plurality of magnets and the second plurality of magnets are separated by the housing and are not in direct physical contact during the engagement; and wherein the magnetic coupling member is rigid and attached to an architectural support structure.

2. The magnetic coupling member in claim 1, further comprising an interlocking feature or an interlocking opening configured to engage a corresponding structure; wherein the interlocking feature is configured to engage a corresponding interlocking recess thereby permitting the interlocking magnetic coupling member and the corresponding structure to be physically mated.

3. The magnetic coupling member in claim 1, wherein the second arrangement of magnets comprises a second magnetic coupling member.

4. The magnetic coupling member in claim 1, wherein the second arrangement of magnets includes a magnetically attracted material.

5. The magnetic coupling member in claim 1, wherein the magnetic coupling member consists of at least one selected from the group consisting of a fastener opening, a fastener access opening, through-openings, and a support opening.

6. The magnetic coupling member in claim 1, wherein the magnetic coupling member comprises a through-opening configured to permit a wire to be inserted through the through-opening thereby providing a source of electricity to a corresponding structure.

7. The magnetic coupling member in claim 1, wherein the housing is machined or cast and comprised of polymeric material.

8. The magnetic coupling member in claim 1, wherein the housing comprises a connecting surface and an opposing surface; and wherein the first arrangement magnets are selectively arranged and disposed between the connecting surface and the opposing surface of the housing to provide alignment and detachable engagement on the connecting surface with a corresponding arrangement of a second plurality of magnets selectively arranged and disposed between a second connecting surface and an opposing second surface of a second housing.

9. The magnetic coupling member in claim 1, wherein the housing comprises a plurality of recesses configured to house the plurality of magnets.

10. A magnetic coupling member comprising:

a housing; and a first arrangement of a plurality of magnets housed within the housing; and wherein the first arrangement magnets are selectively arranged and disposed to provide alignment and detachable engagement with a corresponding arrangement of a second plurality of magnets;

wherein the first arrangement of magnets consists of two parallel sets of magnets, wherein a first set is in north-south-north orientation and a second set is in south-north-south orientation;

wherein the first plurality of magnets and the second plurality of magnets are separated by the housing and are not in direct physical contact during the engagement; and wherein the magnetic coupling member is rigid and attached to an architectural support structure.

11. A method of assembling structures comprising:

providing a magnetic coupling member; wherein the magnetic coupling member comprises a first arrangement of a plurality magnets selectively arranged and disposed to provide alignment and detachable engagement with a corresponding arrangement of a second plurality of magnets;

wherein at least two of the first plurality of magnets are arranged in a position to receive repulsive forces from at most three of the corresponding arrangement of the second plurality of magnets and to receive attractive forces from at most one of the corresponding arrangement of the second plurality of magnets during engagement; wherein the arrangement of the magnets permits the magnetic coupling member to attach to a corresponding structure in one specific position;

providing a corresponding structure having a second arrangement of magnets; and engaging the magnetic coupling member and the corresponding structure together; wherein at least two of the first arrangement of magnets are arranged in a position to receive repulsive forces from only three of the corresponding arrangement of the second plurality of magnets during the engagement, wherein the first arrangement of magnets and second arrangement are separated by at least one housing; and wherein the corresponding structure is rigid and an architectural support structure.

12. The method of claim 11, wherein the first arrangement of magnets consists of two sets of magnets, wherein a first set is in north-south-north orientation and a second set is in south-north-south orientation.

13. The method of claim 11, further comprising inserting a wire through a through-opening thereby providing a source of electricity to the corresponding structure.

14. An attachment system comprising:

a first housing comprising a first arrangement of magnets; and a second housing comprising a second arrangement of magnets, detachably engageable to the first housing; and wherein the first housing is selectively arranged and disposed to provide alignment and detachable engagement with the second housing;

wherein at least two of the first plurality of magnets are arranged in a position to receive repulsive forces from at most three of the corresponding arrangement of the second plurality of magnets and to receive attractive forces from at most one of the corresponding arrangement of the second plurality of magnets during engagement; wherein the arrangement of the magnets permits the magnetic coupling member to attach to a corresponding structure in one specific position;

wherein the first arrangement of magnets and the second arrangement of magnets are separated by the first housing and the second housing and are not in direct physical contact during the engagement; and wherein the attachment system is rigid and attached to an architectural support structure.

15. The system of claim 14, wherein the architectural support structure is attached to a housing selecting from the group consisting of the first housing, the second housing and combinations thereof.

16. The system of claim 14, wherein the architectural support structure includes a component of a ceiling affixed to a housing selecting from the group consisting of the first housing, the second housing and combinations thereof.

17. The system of claim 14, wherein the architectural support structure includes a component of scaffolding affixed to a housing selecting from the group consisting of the first housing, the second housing and combinations thereof.

18. The system of claim 14, wherein the architectural support structure includes a theatrical set affixed to a housing selecting from the group consisting of the first housing, the second housing and combinations thereof.

19. The system of claim 14, wherein the architectural support structure includes a covering affixed to a housing selecting from the group consisting of the first housing, the second housing and combinations thereof.

20. The system of claim 14, wherein the first housing comprises a first connecting surface and a first opposing surface; and the second housing comprises a second connecting surface and a second opposing surface; and wherein the first arrangement of magnets are arranged between the first connecting surface and the first opposing surface of the first housing; and the second arrangement of magnets are arranged between the second connecting surface and the second opposing surface of the second housing; and wherein the second housing is detachably engageable to the first housing via the first connecting surface engaging the second connecting surface.

21. The system of claim 14, wherein the detachable engagement of the first housing with the second housing provides alignment in a specific position and specific orientation which prevents linear sliding or adjustability of the first housing relative to the second housing.

* * * * *